US006162013A

United States Patent [19]

Källberg

[11] Patent Number: 6,162,013

[45] Date of Patent: Dec. 19, 2000

[54] STEAM TURBINE

[75] Inventor: Lars Källberg, Finspäng, Sweden

[73] Assignee: ABB Stal AB, Finspang, Sweden

[21] Appl. No.: 09/171,810

[22] PCT Filed: May 14, 1997

[86] PCT No.: PCT/SE97/00795

§ 371 Date: Oct. 27, 1998

§ 102(e) Date: Oct. 27, 1998

[87] PCT Pub. No.: WO97/43522

PCT Pub. Date: Nov. 20, 1997

[30] Foreign Application Priority Data

May 15, 1996 [SE] Sweden ..... 9601870

[51] Int. Cl.[7] ..... F01D 3/02

[52] U.S. Cl. ..... 415/100; 415/150; 415/159

[58] Field of Search ..... 415/148, 150, 415/151, 156, 157, 159, 100

[56] References Cited

U.S. PATENT DOCUMENTS 1,542,162 6/1925 Moore .
2,235,547 3/1941 Blowney ..... 253/69
5,269,648 12/1993 Freuschle ..... 415/148

FOREIGN PATENT DOCUMENTS 2 589 517 5/1987 France .

*Primary Examiner*—Edward K. Look
*Assistant Examiner*—Hermes Rodriguez
*Attorney, Agent, or Firm*—Pollock, Vande Sande & Amernick, RLLP

[57] ABSTRACT

An arrangement to regulate the flow of steam extracted intermediately from a steam turbine and to induce a steam flow, between separate turbine parts, in a direction that is essentially axial with respect to the rotational direction of the turbine rotor. The steam turbine consists of two turbine parts separated by a partition wall and has an intermediate steam extraction outlet located between the first turbine part and the partition wall. Steam may pass between the two turbine parts through a passage, within the partition wall, having an externally controlled valve used to regulate the steam flow. The valve is configured to reduce the external force needed to control its position. Together, the valve and passage are configured to minimize the pressure loss and turbulence of the steam flow as it passes between the two turbine parts so that the steam flow pressure on the second turbine part is maximized.

15 Claims, 3 Drawing Sheets

STEAM TURBINE

FIELD OF THE INVENTION

The present invention relates to a steam turbine comprising a rotor, rotatable around a longitudinal axis, and the following successively arranged components: a steam inlet; a first turbine part having at least one turbine stage; an intermediate steam outlet; a partition wall having steam passage means; a second turbine part having at least one turbine stage; and a steam outlet, with the passage means having a valve means adapted to control the steam flow therethrough.

BACKGROUND OF THE INVENTION

Steam turbines having such an intermediate steam extraction outlet are known. They are utilized in many different applications, such as chemical industry or process industry, where there is a need for steam of a determined pressure or temperature. One such example is an integrated paper mill where steam of relatively high temperature is needed for the pulping process and steam of a relatively lower temperature is needed for drying the paper.

In order to control the extraction of steam, it is known to provide a valve mechanism. Thereby, one may differ between internally controlled extraction and externally controlled extraction. Whereas externally controlled extraction merely includes a valve mechanism provided on the extraction outlet conduit, internally controlled extraction involves a valve mechanism within the casing of the steam turbine. A number of different solutions have been proposed in the past.

According to one solution, the steam from a first turbine part is guided radially outwards and collected in chambers that are disposed radially outside the normal casing of the turbine. The non-extracted steam is, by means of a valve arrangement guided along a complicated flow path radially inwards to the inlet of a second turbine part. This solution is very bulky and the flow of the steam is disturbed, resulting in relatively high pressure losses.

According to another solution, a rotatable disk having a number of openings is provided downstream of a steam extraction outlet but upstream of a partition wall having a corresponding number of openings. By rotating the disk the disk openings may be aligned with the partition wall openings, thus permitting a steam flow from a first turbine part to a second turbine part. The disadvantages of this solution are that the rotation of the disk requires forces which may be difficult to attain when the pressure of the steam is high, and that the possible opening area is limited to half the inlet area of the turbine part that is downstream of the partition wall. Also, in this solution, the steam flow is disturbed, resulting in relatively high losses of pressure.

According to still another solution, a partition wall is provided in a plane to which the longitudinal axis of the turbine forms the normal and downstream a steam extraction outlet. The wall has a number of passages provided with valve disks disposed against a valve seat in a plane perpendicular to the first mentioned plane. The valve disks may be lifted from the seats along a tangential direction. Also this arrangement results in a complicated flow path involving several changes of the steam flow direction.

SUMMARY OF THE INVENTION

The object of the invention is to overcome the problems mentioned above and provide an improved device for regulating the flow of steam extracted intermediately from a steam turbine. In particular, the device should be compact and operable in an easy manner.

This object is obtained by means of the steam turbine having valve means comprising at least one valve disk rotatable around an axis essentially perpendicular to the steam flow that is adjacent to the valve means. With such a valve means, the valve disk may be disposed within the essentially axial steam flow path. Therefore, the building dimensions of the valve means are small and the valve disk does not need additional radial space. This means that the usual outer diameter of a steam turbine casing may be maintained. Furthermore, with such a rotatable valve disk the steam flow forces acting on the valve disk may be balanced with respect to the disk axis, so that the forces needed to adjust the position of the valve are relatively low. Moreover, by a relatively low opening degree of such a valve means, the valve disk has a directional component in the direction of the steam flow, thereby guiding the steam flow rather than throttling it. Such a valve means permits internally controlled steam extraction for an external process with a constant pressure of the steam extracted within a wide flow range. According to an embodiment thereof, the passage is shaped so that the direction of the steam therethrough is essentially axial and peripheral in the rotational direction of the rotor. Thus, a relatively straight steam flow path is obtained, leading to minimal pressure losses. It also makes it possible to keep a high velocity of the steam through the passage means and valve means. Thus, the performance of the steam turbine may be improved. In particular, the valve disk axis may be essentially radial. By so directing the valve disk axis, the valve disk will guide the flow towards the inlet of the second turbine part, irrespective of the angle of the valve disk.

According to another embodiment, the valve means contains a control means adapted to control the rotation of the valve disk. The control means is adapted to control the rotation of the valve disk, to regulate the steam flow through the passage means and thus the pressure of the steam of the intermediate steam outlet.

Moreover, the object stated above is obtained by means of the steam turbine, previously described, having a valve means comprising at least one valve disk that is movable in a direction essentially radial to the longitudinal axis of the turbine. Also, by such a valve means, the valve disk may be disposed within the essentially axial steam flow path and, therefore, the building dimensions of the valve means are compact and the outer diameter of the casing may be maintained. The area of such a valve disk need not be extensive and, therefore, the steam flow forces acting thereon may be held to a moderate level, such that the operation of the valve disk always may be guaranteed. Also, such a valve means permits internally controlled steam extraction, for an external process, with a constant pressure of the steam extracted within a wide flow range. According to an embodiment thereof, the valve means comprises a control means adapted to control the essentially radial movement of the valve disk. Thereby, the control means is adapted to control the essentially radial movement of the valve disk, to regulate the steam flow through the passage means and thus the pressure of the steam of the intermediate steam outlet. Preferably, the valve disk is movable in a plane to which the longitudinal axis essentially forms the normal. According to a further embodiment, the passage means is shaped so that the direction of the steam flow therethrough is essentially axial and a straight steam flow path therethrough is obtained. This configuration provides to minimal losses of pressure, a high velocity of the steam and an improved performance of the steam turbine.

According to another embodiment of the present invention, the valve disk axis is essentially perpendicular to the longitudinal axis.

According to a further embodiment, the passage means forms separate chambers each extending between one valve disk and a part of the inlet of the second turbine part. By such an embodiment, the steam turbine may be operated with a partial flow in an efficient manner.

According to another embodiment of the present invention, the passage means is shaped such that the steam outlet cross-sectional area essentially corresponds to the cross-sectional area of the inlet of the second steam turbine part. Thus, the steam introduced to the second turbine part may be distributed over the total inlet area of the turbine part.

According to another embodiment of the present invention, the passage means comprises two or more passages through the partition wall.

According to another embodiment of the present invention, the radial distance from the longitudinal axis of the turbine to the outlet side of the first turbine part is essentially the same as to the inlet side of the passage means.

According to another embodiment of the present invention, the steam turbine comprises a casing enclosing the components. Thereby, said valve means may comprise a drive means provided outside the casing and connected to the valve disk by means of a shaft extending through said casing.

BRIEF DESCRIPTION OF THE DRAWINGS

The present invention will now be explained more fully by the description of different embodiments thereof and by reference to the accompanying drawings.

DETAILED DESCRIPTION OF THE PREFERRED EMBODIMENTS

Figure 1:
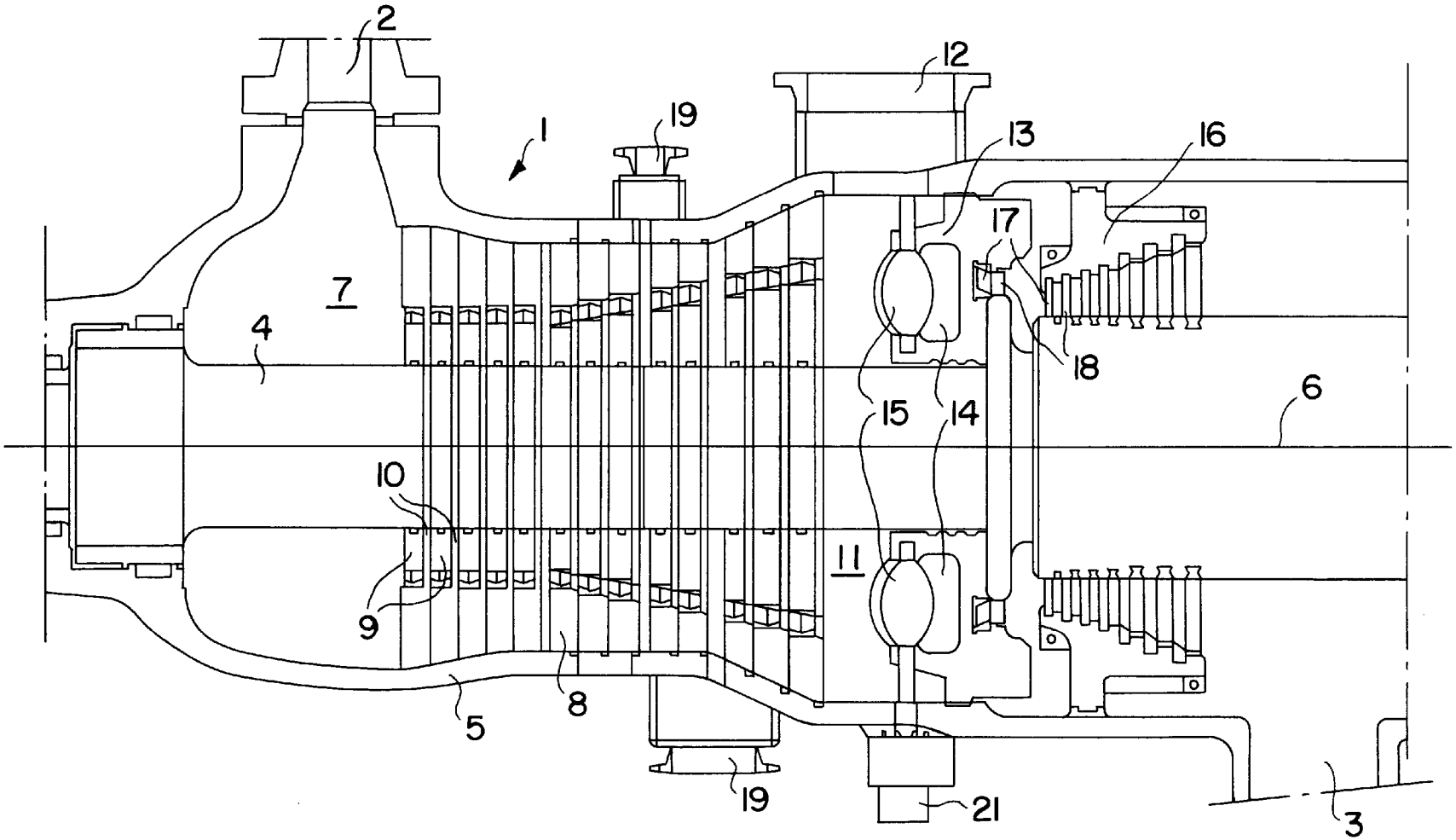
FIG. 1 shows a longitudinal section of a steam turbine according to an embodiment of the present invention.

FIG. 1 shows a steam turbine 1 having a schematically disclosed steam inlet 2 and a schematically disclosed steam outlet 3. It should be noted, that the end portions of the steam turbine 1 have been omitted in FIG. 1. The steam turbine 1 comprises a rotor 4 supported in a casing 5 and rotatable about a longitudinal axis 6. Downstream of the steam inlet 2, there is provided an inlet chamber 7 followed by a first turbine part 8 having a number of turbine stages, each comprising a stationary guide blade rim 9 and a rotor blade wheel 10. It should be noted that the inlet chamber 7 may be divided into two or more individually controlled inlet chambers to permit partial operation. Downstream of the turbine part 8, there is provided a space 11 having an intermediate steam outlet 12. Downstream of the space 11, there is provided a partition wall 13 having four passages 14 therethrough, see FIGS. 2 and 3. The inlet side of the passages 14 comprises a valve means in the form of a valve disk 15, to be described later. The outlet side of the passages 14 are followed by a second turbine part 16 having a number of turbine stages, each comprising a stationary guide blade rim 17 and a rotor blade wheel 18. Downstream of the second turbine part 16 follows the outlet 3. Moreover, the steam turbine 1 may comprise several intermediate steam outlets, 19, of different dimensions and for different purposes.

Figure 2:
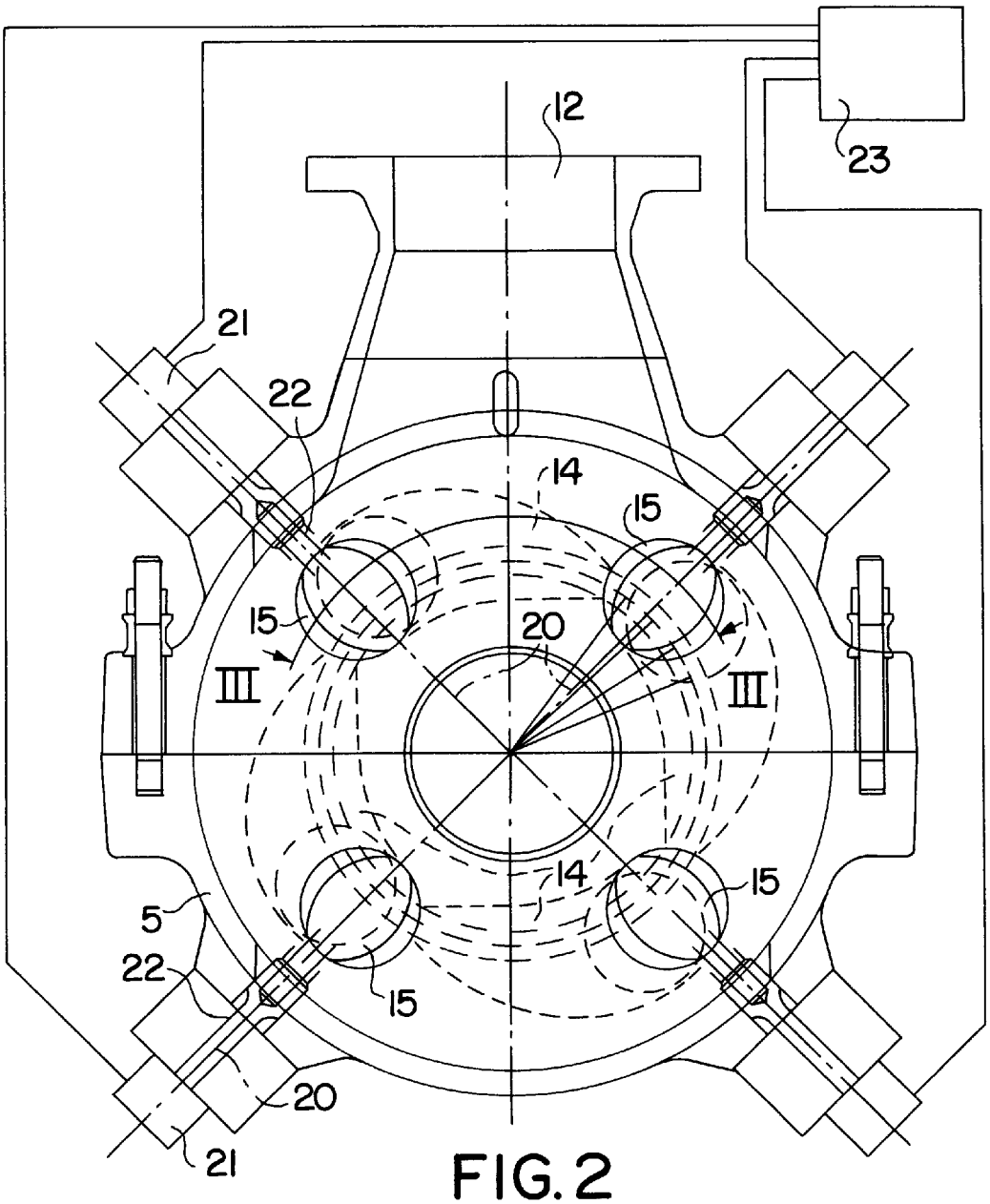
FIG. 2 shows a cross-section of the steam turbine in FIG. 1.
Figure 3:
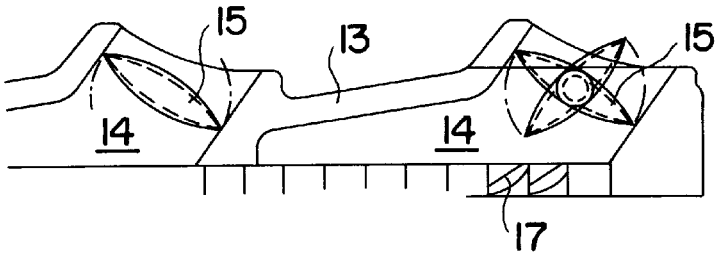
FIG. 3 shows a sectional view along the line III—III in FIG. 2.

With reference to FIGS. 1–3, it may be seen that a valve disk 15 is provided in each of the passages 14 to be rotatable about an axis 20, as a so called butterfly valve. The axis 20 essentially extends through the centre of the valve disk 15. Thus the forces of the steam flow acting on the valve disk 15 may be balanced, because the forces are equal on each side of the axis 20. Therefore, the valve disk 15 may be rotated by means of a relatively small force, facilitating the operation of the valve disk 15. Seen in the direction of the axis 20, each valve disk 15 has a convex shape enclosing a plane comprising the axis 20. Such a shape is advantageous for the guidance of the flow through the passage. It should be noted, however, that the valve disk also may have other shapes seen in the direction of the axis 20. For example, the valve disk may be essentially flat or it may be curved in a convex form on one side and a concave form on the other side. Seen in the direction of the passages 14, each valve disk 15 is circular in the embodiment disclosed. However, also other shapes are possible, for example an oval or elliptic shape or a more rectangular or other polygonal shape. Each of the valve disks 15 is connected to a respective drive means 21 by a rotatable shaft 22. Each individual drive means 21 may be connected to the control system of the steam turbine 1, which is schematically indicated at 23. As may be seen from FIGS. 1 and 2, the drive means 21 are provided outside the casing 5 and the shafts 22 extend through the casing along the axis 20 in an essentially radial direction. It should be noted that the axis 20 also may be directed someday other than in a radial direction, for example in a tangential direction. The axis 20 may also be inclined, with respect to the longitudinal axis 6 of the steam turbine, in a forward or backward direction.

As may be seen from FIGS. 2 and 3, the passages 14 extend in an essentially axial and peripheral direction from the rotational direction of the rotor 4. Each passage 14 forms a separate chamber between one valve disk 15 and the inlet 17 of the second turbine part 16. The inlet of the second turbine part is formed by the guide blade rim 17, see FIG. 3. As may be seen from FIG. 2, each passage 14 and its associated valve disk 15 covers essentially a quarter of the total inlet area of the guide blade rim 17. Each such chamber is closed with respect to adjacent chambers, thereby preventing steam from passing from one chamber to another. This arrangement permits an efficient partial load operation, for example where one valve disk 15 is in an open position and the other three valve disks 15 are in a closed position.

The cross-sectional area of the passages 14 decreases in the direction of the steam flow. It may also be seen from these figures that the outlet cross-sectional area of the passages 14 essentially corresponds to the cross-sectional area of the inlet of the second turbine part 16.

Frequently, it is desired to maintain a constant pressure of steam leaving the steam turbine 1 through the intermediate steam outlet 12. This may be done, using by the valve means disclosed in FIGS. 1–3, by controlling the rotation or opening degree of the valve disk 15. If all of the valve disks 15 are closed, a maximum amount of steam flow will be guided through the intermediate steam outlet 12. By slightly opening one or more of the valve disks 15, a portion of the steam is guided through the corresponding passage or passages 14 to the second turbine part 16, thereby reducing the steam flow and the pressure to the intermediate steam outlet 12. Thus, the pressure of the steam extracted through the outlet 12 may be held constant, while the steam flow through the steam turbine 1 varies over a wide range.

Figure 4:
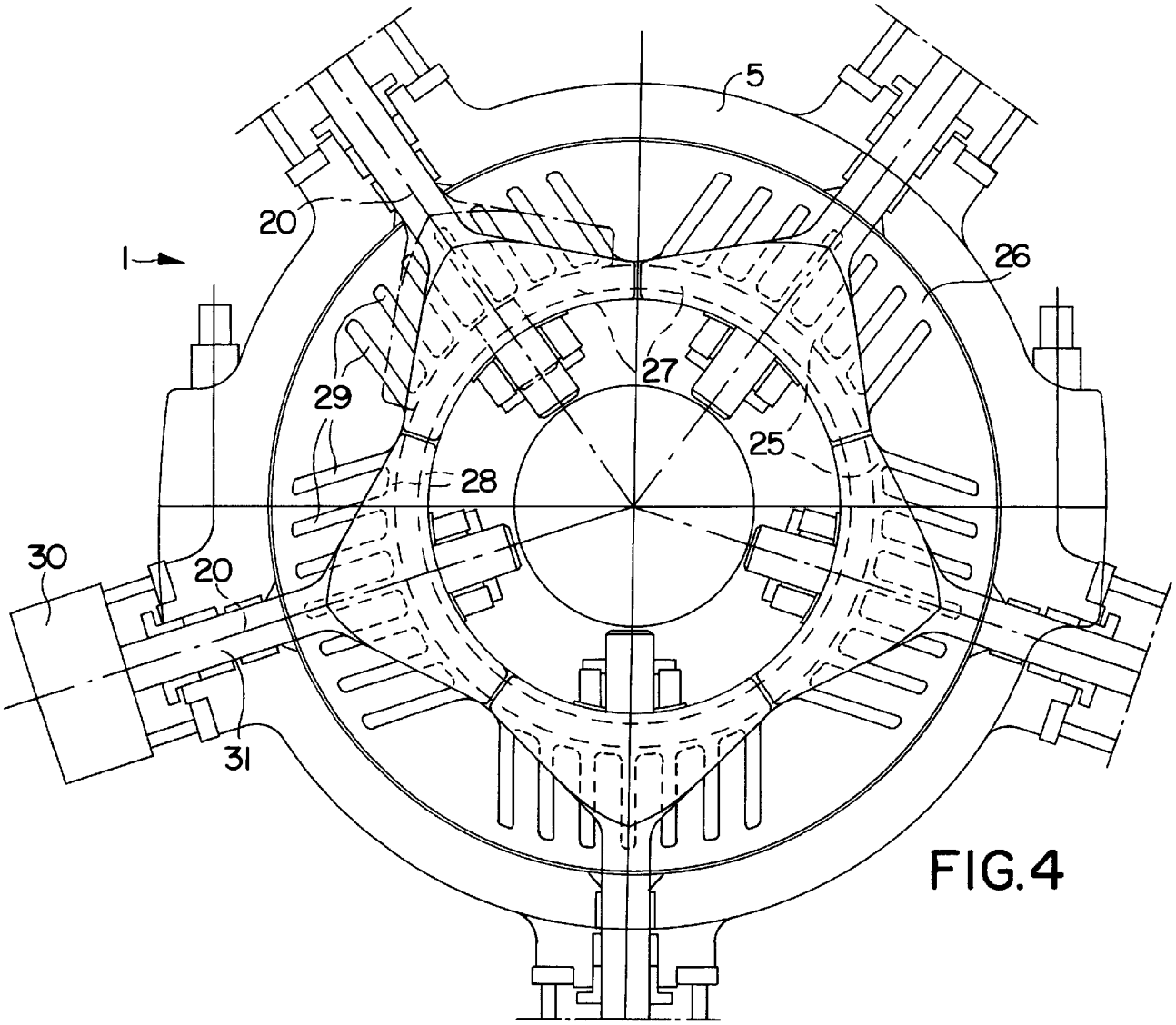
FIG. 4 shows a cross-section similar to FIG. 2 of steam turbine according to another embodiment of the present invention.

FIG. 4 discloses a second embodiment of the steam turbine 1, according to the present invention. It should be noted that components having a corresponding structure and function are provided with the same reference signs in all embodiments. The valve means according to this embodiment comprises five slidable valve disks 25 arranged in a circular arrangement with each being slidable along an axis 20 extending in an essentially radial direction. The valve disks 25 are disposed upstream of the partition wall 26. The partition having a passage 27, with a ring-shaped cross-section, and being essentially concentric with respect to the longitudinal axis 6 of the steam turbine 1. When the valve disks 25 are withdrawn and the passage 27 is fully open the cross-section area thereof corresponds to the inlet area of the guide blade rim 17. By such a passage 27, at least a portion of the steam flow may be guided in an essentially straight axial direction from the first turbine part 8 to the second turbine part 16. The partition wall 26 includes a projecting valve seat 28 extending in a peripheral direction on both sides of the passage 27. Moreover, there is provided projecting ribs 29 for the guidance and support of the wall disks 25. Both the ribs 29 and the valve seat 28 are projecting backwards to essentially the same height. During the opening and closing movement, the valve disks 25 are sliding on the seat 28 and the ribs 29 in a plane to which the longitudinal axis 6 of the steam turbine 1 essentially forms the normal. Each of the valve disks 25 is connected to a respective drive means 30 (only one is disclosed in FIG. 4) by a shaft 31. As in the embodiment disclosed in FIGS. 1–3, each individual drive means 30 may be connected to the control system of the steam turbine 1. As may be seen from FIG. 4, the drive means 30 are provided outside the casing 5 and the shafts 31 extend through the casing 5 along the axis 20 in an essentially radial direction. Seen in the axial direction of the steam turbine 1, the valve disks 25 have an almost triangular shape such that the passage 27 may be fully covered when the wall disks 25 are closed. Other shapes would also be possible. Since the valve disks 25 have a relatively small area seen in the axial direction of the steam turbine 1, the steam flow forces acting on the valve disks 25 may be overcome by usual drive means 30. Moreover, due to the projecting ribs 29 and the space between them, the pressure in the chamber upstream of the partition wall 26 may also act on a substantial part of the back side of each valve disk 25, and therefore the friction against the seat 28 and the ribs 29 may be reduced.

Thus, by opening one or more of the valve disks 25, the pressure of the steam extracted through the outlet conduit 12 may be controlled, for example to an essentially constant level, in the same manner as in the first embodiment disclosed in FIGS. 1–3.

The present invention is not limited to the embodiments disclosed but may be varied and modified within the scope of the following claims. For example, the slidable valve disks 25 may be made smaller and provided to cover an opening of a passage as disclosed in FIGS. 1–3. Moreover, the steam turbine 1 may comprise more than one steam extraction outlet 12 and valve means 15, for example with a turbine part comprising at least one turbine stage between each such extraction arrangement. In particular, it should be noted that an upstream valve means may include a valve disk 15, as disclosed in the first embodiment, and that a downstream valve means may include a valve disk 25, as disclosed in the second embodiment. According to a further embodiment a by-pass channel may be provided in one or more of the passages 14, to by-pass the steam flow thereof past the first guide blade rim 17 and the first rotor blade rim 18. In such a way, a greater steam flow may pass through the second steam turbine part (16).

What is claimed is:

1. A steam turbine comprising a rotor rotatable around a longitudinal axis thereof and the following components successively arranged along said longitudinal axis:

a steam inlet communicating with a first turbine part having at least one turbine stage; an intermediate steam outlet; a partition wall having a steam passage means;

a second turbine part having at least one turbine stage; and a second turbine part steam outlet, said passage means being provided with a valve means adapted to control the steam flow therethrough, said valve means comprising at least one valve disk rotatable around an axis essentially perpendicular to the steam flow adjacent said valve means and essentially radial with respect to the longitudinal axis of said rotor.

2. A steam turbine according to claim 1, wherein said valve means comprises a control means adapted to control the rotation of said valve disk.

3. A steam turbine according to claim 2, wherein said control means is adapted to control the rotation of said valve disk to regulate the steam flow through said passage means and thus the pressure of the steam through said intermediate steam outlet.

4. A steam turbine according to claim 1, wherein said passage means is shaped such that the direction of the steam therethrough is essentially axial and peripheral in the rotational direction of said rotor.

5. A steam turbine comprising a rotor rotatable around a longitudinal axis thereof and the following components successively arranged along the longitudinal axis:

a steam inlet communicating with a first turbine part having at least one turbine stage; an intermediate steam outlet; a partition wall having a steam passage means; a second turbine part having at least one turbine stage; and a second turbine part steam outlet, said passage means being provided with a valve means adapted to control the steam flow therethrough, wherein said passage means is shaped so that the direction of the steam flow therethrough is essentially axial and wherein said valve means comprises at least one valve disk being movable in a direction essentially radial with reference to said longitudinal axis.

6. A steam turbine according to claim 5, wherein said valve means comprises a control means adapted to control the essentially radial movement of said valve disk (25).

7. A steam turbine according to claim 6, wherein said control means is adapted to control the essentially radial movement of said valve disk to regulate the steam flow through said passage means and thus the pressure of the steam through said intermediate steam outlet.

8. A steam turbine according to claim 5, wherein said valve disk is movable in a plane to which the longitudinal axis of said rotor essentially forms the normal.

9. A steam turbine according to claim 1, wherein said valve disk axis is essentially perpendicular to the longitudinal axis of said rotor.

10. A steam turbine according to claim 1, wherein said passage means forms separate chambers each extending between one of said valve disks and a part of the inlet of said second turbine part.

11. A steam turbine according to claim 1, wherein said passage means is shaped so that the steam outlet cross-sectional area thereof essentially corresponds to the cross-sectional area of the inlet of said second steam turbine part.

12. A steam turbine according to claim 1, wherein said passage means comprises two or more passages through said partition wall.

13. A steam turbine according to claim 1, wherein the radial distance from the longitudinal axis of said rotor to the outlet side of said first turbine part is essentially the same as to the inlet side of said passage means.

14. A steam turbine according to claim 1, wherein a casing encloses the components.

15. A steam turbine according to claim 14, wherein said valve means comprises a drive means provided outside said casing and connected to said valve disk by means of a shaft extending through said casing.

* * * * *